United States Patent [19]

Dyment et al.

[11] Patent Number: 4,848,856

[45] Date of Patent: Jul. 18, 1989

[54] ARTICLE DISPLAY APPARATUSES AND ELONGATED, DEFLECTABLE RACKS

[75] Inventors: James A. Dyment, Cincinnati, Ohio; Floyd R. Callon, Punta Gorda, Fla.; Harvey W. Benison, Cincinnati, Ohio; Karl E. Haschart, Cincinnati, Ohio; John S. Veach, Cincinnati, Ohio

[73] Assignee: Dyment Limited, Toronto, Canada

[21] Appl. No.: 166,977

[22] Filed: Mar. 10, 1988

Related U.S. Application Data

[63] Continuation-in-part of Ser. No. 11,206, Feb. 5, 1987, Pat. No. 4,794,764, Continuation-in-part of Ser. No. 764,989, Aug. 12, 1985, Pat. No. 4,663,943.

[51] Int. Cl.[4] ..... A47F 3/10

[52] U.S. Cl. ..... 312/135; 206/427; 206/429; 211/49.1

[58] Field of Search ..... 211/49.1, 59.4, 59; 312/42, 45, 135, 116, 15; 221/76, 120, 121, 310, 150 R; 206/427, 429; 220/23.4

[56] References Cited

U.S. PATENT DOCUMENTS

| | | |
|---|---|---|
| D. 244,019 | 4/1977 | Brown . |
| D. 245,299 | 8/1977 | Beck . |
| 295,746 | 3/1984 | Foster et al. . |
| 316,062 | 4/1985 | Riessner . |
| 822,984 | 6/1906 | Richter . |
| 838,031 | 12/1906 | Kirkpatrick . |
| 1,080,530 | 12/1913 | Bair . |
| 1,082,078 | 12/1913 | Gibson et al. . |
| 1,119,702 | 12/1914 | Infeld . |
| 1,189,371 | 7/1916 | Lyons . |
| 1,245,805 | 11/1917 | Schneider . |
| 1,252,287 | 1/1918 | Mifflin . |
| 1,382,092 | 6/1921 | Kilmer . |
| 1,389,984 | 9/1921 | Reed . |
| 1,428,275 | 9/1922 | Dahl . |
| 1,524,748 | 2/1925 | O'Connor . |
| 1,570,731 | 1/1926 | Duff et al. . |
| 1,581,749 | 4/1926 | Mahony . |
| 1,618,178 | 2/1927 | Erdoes . |
| 1,715,276 | 5/1929 | Burns . |
| 1,719,146 | 7/1929 | Stringer . |
| 1,728,512 | 9/1929 | Sharp . |
| 1,883,961 | 10/1932 | Kosmerl . |
| 1,905,180 | 4/1933 | Lowther . |
| 1,923,032 | 8/1933 | Frick et al. . |
| 1,934,133 | 11/1933 | Lauderback . |
| 1,951,617 | 3/1934 | Kress . |
| 1,991,102 | 2/1935 | Kernaghan . |
| 2,013,901 | 9/1935 | Shankland . |
| 2,052,801 | 9/1936 | Russakov . |
| 2,070,055 | 2/1937 | Levien . |
| 2,080,947 | 5/1937 | Ligeour . |
| 2,176,823 | 10/1939 | Richardson . |
| 2,212,129 | 8/1940 | Rust . |
| 2,280,003 | 4/1942 | Pearson . |

(List continued on next page.)

FOREIGN PATENT DOCUMENTS

| | | |
|---|---|---|
| 2009640 | of 1979 | Fed. Rep. of Germany . |
| 2268702 | of 1975 | France . |
| 359017 | of 1962 | Switzerland . |

*Primary Examiner*—Joseph Falk

*Attorney, Agent, or Firm*—Wood, Herron & Evans

[57] ABSTRACT

An article display apparatus comprises a base, a hollow housing having a transparent outer wall and an article support rack rotatably mounted within the interior of the housing which displays and supports articles stacked end-to-end in vertical columns about the circumference of the housing. The article support rack is formed of a plurality of plastic extrusions each having two semicircular-shaped columns. Each column comprises a pair of spaced, flexible gripping arms which extend vertically along the axial length of the housing. The gripping arms of each column have opposed article gripping portions adapted to receive and grip an article therebetween, and opposed outer ends which deflect apart upon insertion or removal of an article within the gripping portions. Each plastic extrusion is also formed with male and female locking elements which permit adjacent extrusions to removably interlock with one another to form the article support rack. Alternatively, the plastic extrusions are directly and permanently connected to one another to form an article display rack in which adjacent columns are either colinear or oriented at an angle relative to one another.

49 Claims, 5 Drawing Sheets

U.S. PATENT DOCUMENTS 2,285,801 6/1942 Burnet .
2,296,700 9/1942 Branstetter et al. .
2,298,790 10/1942 Klassen .
2,301,594 11/1942 Voigtritter .
2,365,995 12/1944 Baker, Sr. .
2,401,578 6/1946 Miller .
2,428,498 10/1947 McWilliams .
2,431,837 12/1947 Spotts et al. .
2,435,177 1/1948 Connell et al. .
2,435,698 2/1948 Running .
2,453,030 11/1948 Newman ..... 211/49.1
2,462,051 2/1949 Starr .
2,462,375 2/1949 Flaherty .
2,463,658 3/1949 Thrasher .
2,463,664 3/1949 Watson .
2,474,452 6/1949 Amyot .
2,477,393 7/1949 Skoog et al. .
2,537,686 1/1951 Mertz et al. .
2,556,439 6/1951 Pearson .
2,559,060 7/1951 Zenick .
2,560,255 7/1951 Shirley ..... 221/121 X
2,598,492 5/1952 Boes .
2,599,111 6/1952 Kicher .
2,610,473 9/1952 Chovanec ..... 312/116
2,621,429 12/1952 Teich .
2,637,475 5/1953 Gialanella .
2,645,352 7/1953 Petzold ..... 211/49.1
2,647,029 7/1953 Deland .
2,652,154 9/1953 Stevens .
2,662,644 12/1953 Alexander .
2,672,735 3/1954 Fusselman .
2,672,741 3/1954 Bernhardt .
2,706,387 4/1955 Swanson .
2,707,052 4/1955 Brown .
2,715,467 8/1955 Smith .
2,732,098 1/1956 Lime et al. .
2,741,913 4/1956 Dovas .
2,791,889 5/1957 Childers .
2,792,111 5/1957 Ringler et al. .
2,813,625 11/1957 Seyforth .
2,903,139 9/1959 Penman .
2,986,019 5/1961 Happer .
3,025,681 3/1962 Booth .
3,081,819 3/1963 Lydard .
3,115,019 12/1963 Rutishauser .
3,128,119 4/1964 Walter .
3,179,289 4/1965 Moyer et al. .
3,275,159 9/1966 James et al. .
3,287,073 11/1966 Holtkamp .
3,294,284 12/1966 Chambers ..... 221/120
3,305,100 2/1967 Barbee .
3,306,068 2/1967 Allgeyer et al. .
3,331,515 7/1967 Lange .
3,338,452 8/1967 Oakley et al. ..... 220/23.4
3,359,031 12/1967 Werrett .
3,365,907 1/1968 Barroero .
3,410,385 11/1968 Freet et al. .
3,417,873 12/1968 Leptrone .
3,449,848 6/1969 Howell .
3,462,966 8/1969 Reid et al. .
3,471,210 10/1969 Barroero ..... 312/116 X
3,477,774 11/1969 Atwood .
3,503,518 3/1970 Black .
3,508,229 4/1970 Stencel, Jr. et al. .
3,526,443 9/1970 Smith .
3,552,138 1/1971 Davis .
3,590,752 7/1971 DePew .
3,620,363 11/1971 Donnithorne .
3,627,395 12/1971 Hoey .
3,712,507 1/1973 Holt .
3,769,805 11/1973 Corini .
3,788,487 1/1974 Dawson ..... 211/49.1
3,913,778 10/1975 Oglesbee .
3,941,237 3/1976 MacGregor, Jr. .
3,946,877 3/1976 Galicia .
3,998,334 12/1976 Smith .
4,006,824 2/1977 Snediker et al. .
4,019,269 4/1977 Vix .
4,022,363 5/1977 Eliassen .
4,030,608 6/1977 Howard .
4,085,986 4/1978 Taub .
4,093,076 6/1978 Newton .
4,106,629 8/1978 Doyle et al. .
4,144,662 3/1979 Drexler .
4,148,533 4/1979 Bustos et al. .
4,182,455 1/1980 Zurawin .
4,183,438 1/1980 Huczek .
4,257,524 3/1981 Yonkers et al. ..... 312/15 X
4,267,706 5/1981 Abraham .
4,305,512 12/1981 MacKenzi .
4,310,097 1/1982 Merl .
4,314,458 2/1982 Hade et al. .
4,350,253 9/1982 Rusteberg .
4,356,923 11/1982 Young et al. .
4,367,818 1/1983 Suttles .
4,373,355 2/1983 Monroe .
4,387,810 6/1983 Crosslen .
4,403,700 9/1983 Manlove .
4,422,555 12/1983 Jacobs .
4,449,761 5/1984 Davis et al. .
4,479,583 10/1984 Franklin et al. .
4,542,830 9/1985 Effort .
4,569,448 2/1986 Graham .
4,660,727 4/1987 Levine .
4,663,943 5/1987 Dyment et al. .
4,688,684 8/1987 Young et al. .
4,690,287 9/1987 Fershko .
4,700,850 10/1987 Morgan et al. .

ARTICLE DISPLAY APPARATUSES AND ELONGATED, DEFLECTABLE RACKS

This application is a continuation-in-part of U.S. patent application Ser. No. 07/011,206, filed Feb. 5, 1987 now U.S. Pat. No. 4,794,764, and entitled "Article Display Apparatus," which is a continuation-in-part of U.S. Ser. No. 764,989 filed Aug. 12, 1985, now U.S. Pat. No. 4,663,943.

FIELD OF THE INVENTION

This invention relates to elongated, deflectable racks and a portable, refrigerated or unrefrigerated display unit embodying such racks for displaying and dispensing individually packaged articles, such as soda cans and bottles, juice cans and boxes or the like, in which the articles are vertically stacked end-to-end in such elongated, deflectable racks within a hollow, transparent housing of such unit.

BACKGROUND

The marketing concept commonly known as "impulse buying" has been used effectively in a variety of retail establishments including supermarkets, convenience food stores, and pharmacies. The idea behind impulse buying is that customers must see certain products before they are motivated to buy. In order to promote implulse buying, such products must be displayed attractively in a location in the store by which most customers are likely to pass.

Various types of display techniques have been employed to promote impulse buying. Supermarkets, pharmacies and other retail establishments display articles on hooks, shelves or in bins at the checkout counters where payment is made for one's purchases. Racks or other multiple shelf displays are often found at the ends of aisles, and a variety of smaller, portable displays are often placed in aisles of supermarkets or pharmacies.

Although displays of the type described above may, in some instances, improve the sales of products which would normally be located on aisle shelves of retail establishments, such displays have deficiencies. Shelves or racks positioned at the ends of aisles closely resemble the aisle shelves and often are not any more effective in drawing the customer's eye to the products thereon than the aisle shelves. Portable displays positioned in the center or at one side of the aisles must be relatively small to avoid disruption of customer traffic flow and thus only a limited number of products can be displayed thereon.

Efforts have also been made to generate impulse buying of food products requiring refrigeration. Article displays of this type have generally included transparent doors or walls with shelves which are angled upwardly from front to back so that all articles on the shelves may be seen by customers. Usually these displays are permanent wall-mounted units having large clear glass doors which provide access to the interior.

Permanent wall-mounted, refrigerated article displays of the type described above present several disadvantages from the standpoint of promoting effective impulse buying. Only the front panel or door of such display devices is clear and thus the product it contains can only be viewed from one direction. In addition, the wall-mounted units typically are permanently mounted in a particular aisle and not portable to various locations around the store. Items such as soft drinks, fruit juices, wine, prepared sandwiches and the like might sell much more quickly if the display apparatus could be moved to a location near the checkout counter of the store or other areas of high customer traffic. Marketing with impulse buying is effective only when the product is located within the customer's view, and permanently mounted wall units often are located in areas of low customer traffic.

Portable, refrigerated display devices have been proposed to improve the effectiveness of impulse marketing compared to wall-mounted displays. Portable, refrigerated displays generally include a clear housing mounted atop a base having rollers for movement of the display to the desired location. The housing includes a plurality of spaced shelves which are accessible by opening a single door mounted to the housing. Display devices of this type are portable and permit in some instances 360° viewing of the articles placed therein. With such display devices, however, the articles are stacked side-by-side therein which presents the problem of concealing those articles that are stacked in the middle of the storage racks or shelves.

SUMMARY OF THE INVENTION

It is therefore among objectives of this invention to provide article support racks and a portable display device embodying such racks particularly intended to enhance impulse buying of retail items which provide a distinctive visual appearance for the articles displayed, which permits easy loading and removal of articles therefrom and which is relatively inexpensive to manufacture and fabricate.

These objectives are accomplished in an article display apparatus which comprises a base, a hollow housing having a transparent outer annular wall and an article support rack mounted in the interior of the housing atop a rotatable article support carriage. The article support rack comprises a plurality of vertically extending, plastic extrusions which are interconnected in an annular shape extending around the cylindrical wall of the housing. Each extrusion is formed with two semicircular-shaped columns which are adapted to support articles end-to-end atop the article support carriage. The plastic extrusions which form the columns of the rack are relatively inexpensive, easy to assemble, provide an attractive display for articles within the housing and permit easy loading and removal of articles at any point along the column through an access opening formed in the housing.

Important aspects of this invention include the distinctive visual appearance provided by the article support rack and housing, and the ease with which customers can access and remove articles from the interior of the display. Articles such as soda bottles or cans, fruit juice cans or boxes, deodorants, shampoos or the like, are displayed end-to-end in the vertically extending columns around the entire periphery of the housing. Preferably, the support rack and articles carried therein are continuously rotated within the housing by the article support carriage to draw the customer's attention to the display and to present all of the articles in the support rack to the customer for viewing regardless of where the customer stands in relation to the display. The housing is formed with an access opening covered by a door which, when opened, stops the rotation of the article support carriage and allows a customer to withdraw an article such as an insulated pop bottle from any point along the length of a column in the rack.

In a presently preferred embodiment, the plastic extrusions forming the columns of the article support rack are attractive in appearance, easy to assemble and permit easy loading and unloading of articles therefrom. Each of the two columns of an extrusion is formed with a pair of spaced, flexible first and second gripping arms which extend vertically along the entire length of the rack. The first and second gripping arms of each column in an extrusion have opposed article gripping portions and opposed outer ends. The transverse dimension between the opposed article gripping portions of a column is slightly less than the transverse dimension of an article to be held therebetween, e.g., a cylindrical soda can, so that the article gripping portions are deformed to some extent when an article is placed therebetween. The transverse dimension of the opposed outer ends of each column in an extrustion is less than that of the article to be displayed. These outer ends are thus spread apart from an undeflected position to a deflected position as an article is inserted therebetween and into the opposed article gripping portions of the column. The flexible outer ends of the opposed gripping arms return to a substantially undeflected position after an article is positioned between the opposed gripping portions of the column thereby helping to retain the article in place.

In a presently preferred embodiment, each column of the article support rack is substantially semicircular in shape with the gripping arms being interconnected at the rearward or back portion of the column opposite the spaced outer ends of the gripping arms. The opposed article gripping portions of the gripping arms are therefore arcuate in shape and closely conform to the outer surface of cylindrical-shaped items such as soda pop cans, bottles, and the like. Nevertheless, other items having approximately the same transverse dimension as the diameter or space between the opposed gripping portions of the column, e.g., rectangular or square-shaped boxes, etc., can also be held within each column of the article support rack.

As mentioned above, each plastic extrusion forming the article support rack is preferably formed with two columns. In one presently preferred embodiment, a gripping arm of one column is fixedly attached or integrally formed with the gripping arm of the other column in each extrusion. Depending upon the size of the product to be displayed within the columns of an extrusion, an elongated rubber seal may be mounted to the gripping portions of adjacent columns where their gripping arms are connected or integrally formed together.

An important aspect of this invention is the provision of locking elements on each two-column extrusion to permit adjacent extrusions to be releasably interconnected together to form the article support rack. In a presently preferred embodiment, one column of a two-column extrusion has a gripping arm formed with a male locking element, and a gripping arm of the other column in the extrusion is formed with a female locking element. The male locking elements comprise an arm having a T-shaped end, and the female locking elements comprise a U-shaped channel having an elongated slot. In order to interconnect one extrusion to another extrusion, the male locking element on a gripping arm of one extrusion is inserted within the U-shaped channel and through the slot of the female locking element carried on a gripping arm of another extrusion. Any number of two column extrusions can be connected together in this manner to form the article support rack.

One advantage of the interlocking arrangement of adjacent two column extrusions forming the article support rack herein is that the locking elements which interconnect adjacent extrusions are somewhat flexible and are loosely fitted together to permit limited angular adjustment of the position of one extrusion relative to an adjacent extrusion. Adjacent extrusions can thus be angled relative to one another to form a substantially annular-shaped rack. Alternatively, adjacent extrusions can be positioned substantially colinear to each other to form a display where all columns are oriented in the same vertical plane and which can be connected to a support structure, such as a wall. This flexibility in the design of the extrusions reduces the cost of manufacture and fabrication of a display apparatus incorporating the extrustions herein since the same extrusion can be used in displays of different appearance.

Another important aspect of this invention is the flexibility of the gripping arms of each column which aids in loading and unloading product held therein. The outer ends of the gripping arms of each column elastically deform or spread apart upon insertion or removal of an article into or from the gripping portions of the column, respectively, and then return to a substantially undeflected position to help retain articles within the gripping portions. The gripping arms of each column are sufficiently flexible to permit their outer ends to be relatively easily deflected by hand so that articles are easily loaded or unloaded from the columns. At the same time, most articles are restrained from vertical movement along the columns by the gripping portions of the gripping arms.

It is contemplated that articles which closely nest with one another and with the gripping arms, such as soda cans, would not be readily removed from or loaded into the columns except from the top end thereof. However, articles which do not nest closely with one another and with the gripping arms, such as insulated soda bottles or fruit juice boxes, can be removed at any point along the column without causing the remaining articles therein to fall out of or downwardly within the column. This occurs because it is believed that the outer ends of the gripping arms of each column deflect in a localized area, e.g., at each point where an article is located therealong, so that most single articles can be removed at any point along the column without spreading the gripping arms apart along the remaining length of the column.

In a presently preferred embodiment, the display apparatus is formed with a refrigeration system substantially identical to that disclosed in U.S. Pat. No. 4,663,943 or in U.S. patent application Ser. No. 07/011,206, filed Feb. 5, 1987. This permits articles such as soda and beer cans, wine, prepared sandwiches, juice in cardboard containers and the like to be attractively displayed and kept fresh by the apparatus herein. Alternatively, the refrigeration system can be removed from the display apparatus for the display of other retail articles which do not require refrigeration.

DESCRIPTION OF THE FIGS.

The structure, operation and advantages of a presently preferred embodiment of this invention will become further apparent upon consideration of the following description, taken in conjunction with the accompanying Figs., wherein.

DETAILED DESCRIPTION OF THE INVENTION

Figure 1:
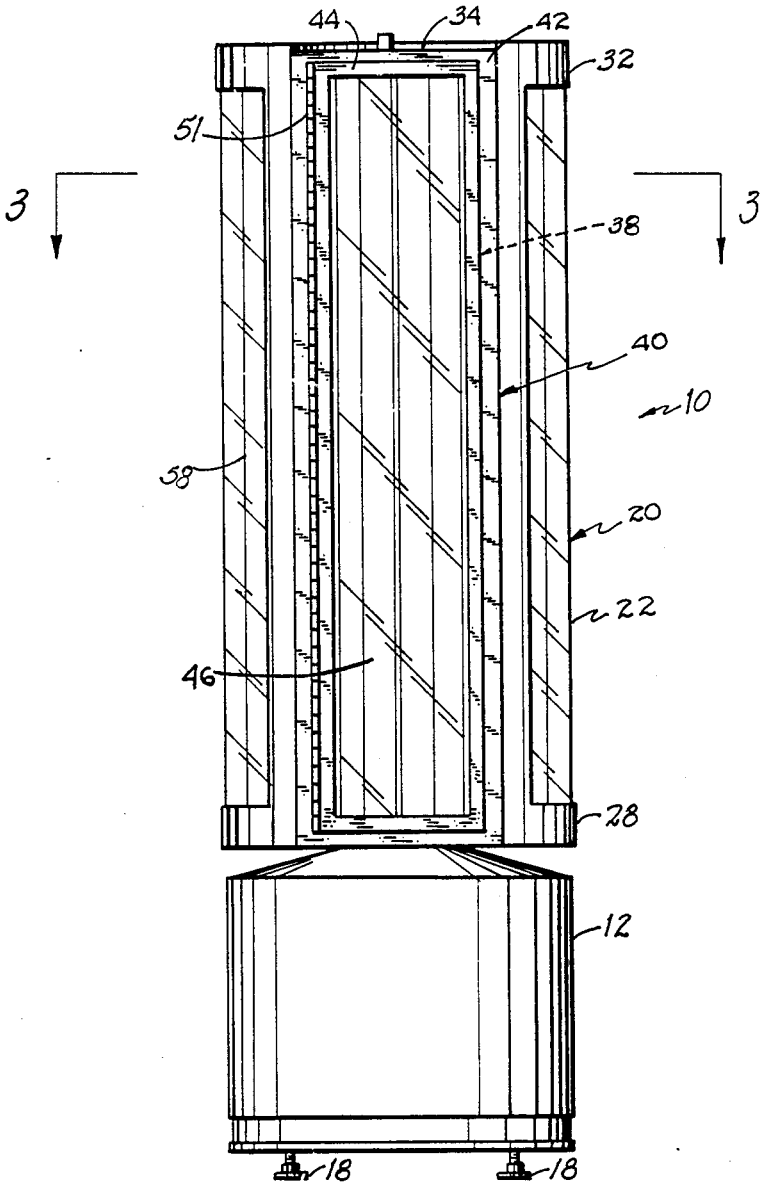
FIG. 1 is a front elevational view of a display apparatus herein.
Figure 2:
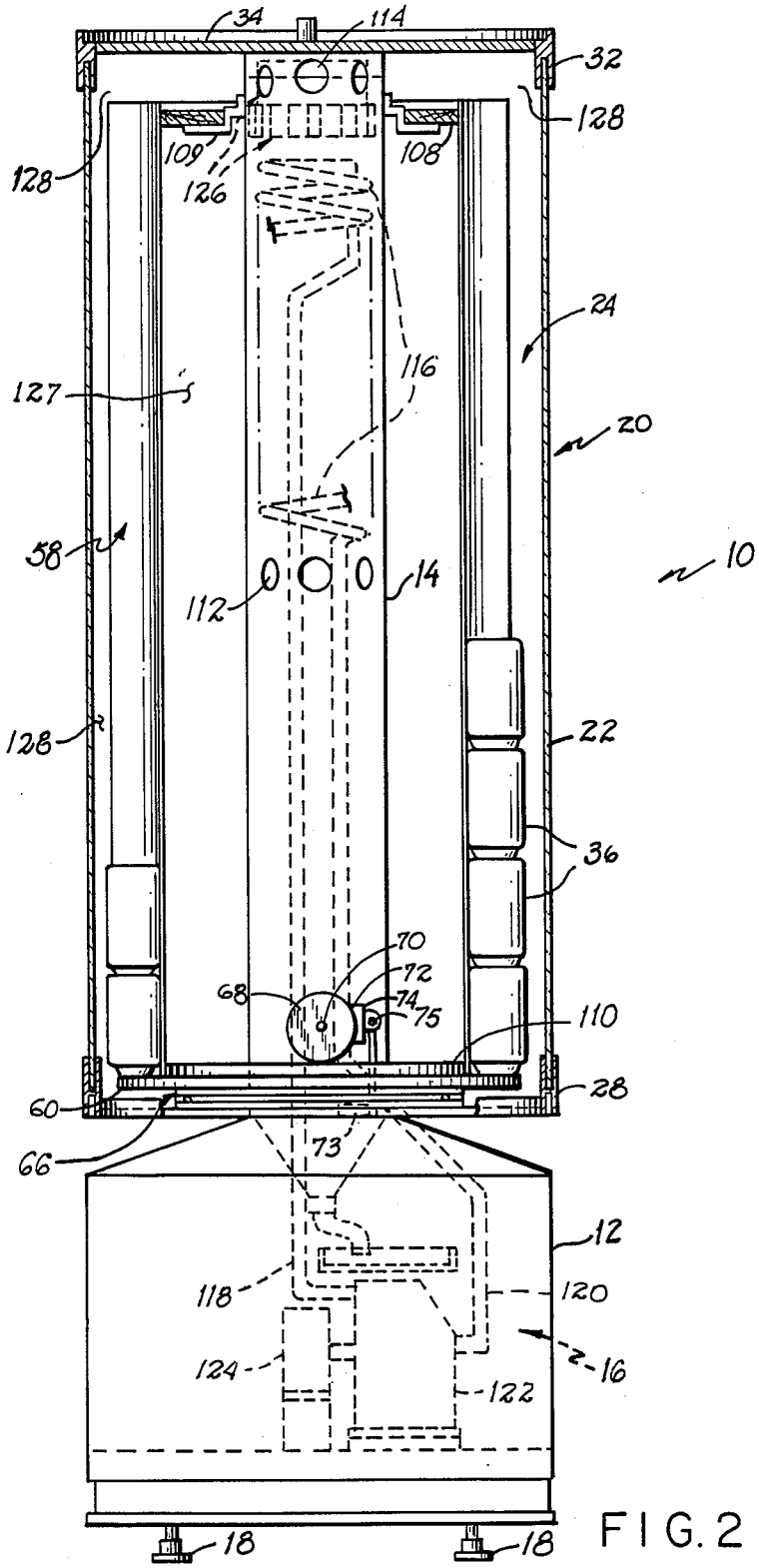
FIG. 2 is an enlarged front view in partial cross section of the display apparatus shown in FIG. 1.

Referring now to FIGS. 1 and 2, the article display apparatus 10 includes a base 12 and a vertically extending, cooling column 14 mounted atop the base 12, both of which house a refrigeration system 16 described in detail below. The base 12 and cooling column 14 are hollow and can be formed of metal, plastic or similar material. Preferably, the base 12 is at least partially filled with a material such as concrete for stability, and is supported on the floor by pads 18 or rollers (not shown) so that the article display apparatus 10 is portable and can be readily moved to different locations at a particular retail establishment.

A housing 20 is mounted atop the base 12 which comprises a transparent, annular outer wall 22, or walls, defining a hollow interior 24. The base of the housing 20 is received within an annular slot formed in an insulative, base plate 28 mounted atop the base 12. The top end of the housing 20 is received within a slot formed in an insulative, annular top plate 32 which is mounted atop the cooling column 14. A cover 34 is carried on the top plate 32 for loading articles 36 into the interior of housing 20, as described below.

Figure 3:
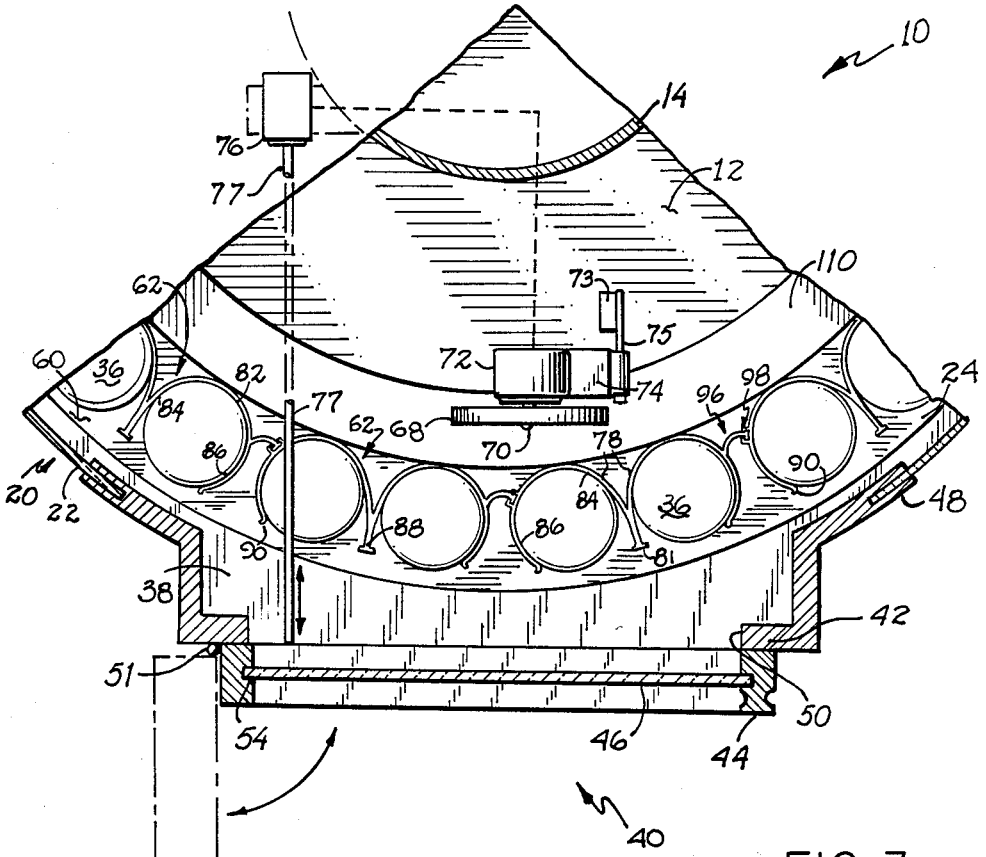
FIG. 3 is a partial cross sectional view of the display apparatus herein taken generally along line 3—3 of FIG. 1.

As shown in FIGS. 1 and 3, the housing 20 is formed with an access opening 38 which extends substantially along the majority of the axial length of the housing 20. A door assembly 40 is mounted over the access opening 38 which comprises a door jamb 42, a door frame 44 and a transparent plate or window 46. The door jamb 42 extends around the periphery of the access opening 38 and has a slot or yoke 48 which is connected to the outer wall 22 of housing 20. The door jamb 42 extends outwardly from the housing wall 22 forming a door opening 50. The door frame 44 is mounted at the door opening 50 of jamb 42 by a piano hinge 51 which extends along one side of the door frame 44. The door frame 44 is formed with a slot 54 which mounts the transparent plate 46. As shown in FIG. 3, the door frame 44 and plate 46 are movable between an open and closed position to permit access to the hollow interior 24 of housing 20.

Figure 5:
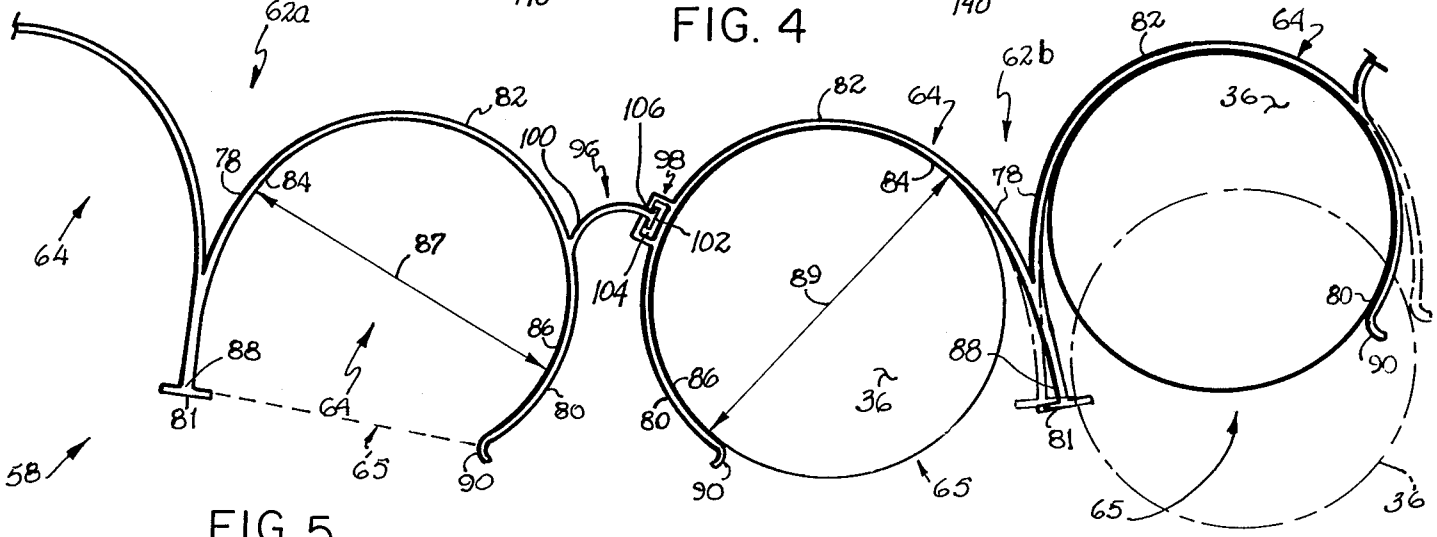
FIG. 5 is a partial, schematic view of an article support rack showing a preferred embodiment of the plastic extrusions forming a display rack herein in which each extrusion is formed with two columns.

Referring now to FIGS. 2, 3 and 5, one presently preferred embodiment of structure is illustrated for supporting articles 36, such as soda cans, within the interior 24 of housing 20. The articles 36 are supported end-to-end in vertical columns along the circumference of housing 20 by an article support rack 58 mounted atop an article support carriage 60. The article support rack 58 is annular in shape and comprises a plurality of interconnected plastic extrusions 62 each having a pair of columns 64, as described in detail below with reference to FIG. 5.

The article support carriage 60 is mounted atop a lazy-susan type bearing 66 carried on the base 12 at the bottom of the housing 20. The article support carriage 60 is rotated on bearing 66 with respect to the fixed housing 20 by a friction wheel 68 drivingly connected to the output shaft 70 of a motor 72. Preferably, the motor 72 is pivotably mounted within the interior 24 of housing 20. An angle bracket 73, fixed to the base 12, extends vertically into the interior 24. At its upper end, within interior 24, the bracket has a pivot shaft 75 fixedly secured thereto. Pivotably mounted on shaft 75 is a flange 74 to which the motor 72 is mounted. The friction wheel 68 rests atop a lower annular spacer 110 of the article support carriage 60 and is rotated by the motor 72, which, in turn, causes the article support carriage 60 and article support rack 58 to rotate with respect to the base 12 and housing 20.

As shown schematically in FIG. 3, operation of the motor 72 is controlled by a switch 76 activated by a wire or rod 77 connected to the door frame 44. Preferably, with the door frame 44 in a closed position, the switch 76 is closed by the rod 77 so that the motor 72 is operated to drive the friction wheel 68 and continuously rotate the article support carriage 60 and article support rack 58. When the door frame 44 is movfed to an open position, shown in phantom in FIG. 3, the switch is also opened by movement of rod 77 which deactivates the motor 72 and stops the rotation of article support carriage 60 and rack 58.

Referring now to FIG. 5, the construction of a presently preferred embodiment of extrusions 62 and columns 64 is shown in detail with reference being made to a pair of extrusions 62*a* and 62*b* and the two columns 64 associated with each extrusion 62*a*, *b*. The extrusions 62*a* and 62*b* are preferably formed of a rigid polyvinylchloride material of the 8700 series sold by B. F. Goodrich under the trademark Geon Vinyls, or a similar rigid plastic material having comparable elastic deformation properties preferably over a temperature range of about −20° to about 100° F. The technical data of one such preferred rigid polyvinylchloride material sold by B. F. Goodrich, rigid extrusion compound 8700A, is provided on the technical data sheet supplied by B. F. Goodrich, which is incorporated herein by reference in its entirety and submitted and filed contemporaneously with this application. The wall thickness of extrusions 62 is preferably in the range of about 0.040 to 0.055 inches, and most preferably about 0.045 inch, when one of the B. F. Goodrich 8700 series materials identified above is used. It has been found that a wall thickness of at least 0.040 inch is necessary to obtain a satisfactory extrusion, and wall thicknesses in excess of about 0.055 inch do not provide the necessary flexibility required to insert and remove articles from the columns 64 as described below. It should be understood that the wall thickness of extrusions 62*a*, *b* may vary if materials other than the B. F. Goodrich 8700 series' materials identified above are employed in order to obtain the required flexibility.

Each of the two columns 64 forming extrusions 62*a* or 62*b* is generally semicircular in shape having a pair of opposed gripping arms 78, 80 which are connected together at an arcuate, back portion 82. Preferably, the extrusions 62*a* and 62*b* are formed such that the gripping arm 78 of one column 64 is attached to or integrally formed with the gripping arm 78 of an adjacent column 64 in the same extrusion 62*a* or 62*b*.

In a presently preferred embodiment, the gripping arms 78, 80 of each column 64 are formed with opposed, internal gripping portions 84, 86, respectively, which are adapted to frictionally grip an article 36 therebetween. The transverse dimension 87 between the gripping portions 84, 86 of each column 64 in the undeflected position, as shown on the lefthand portion of FIG. 5 in extrusion 62*a*, is preferably slightly less than the diameter of an article 36 to ensure that the articles 36 are frictionally held along the columns 64. The transverse dimension 89 between the gripping portions 84, 86 increases to equal that of an article 36 placed therebetween as shown on the righthand portion 9f FIG. 5 in extrusion 62*b*.

Each gripping arm 78, 80 of a column 64 is also formed with elongated outer ends 88, 90, respectively, opposite the back portion 82. The outer ends 88, 90 of each column 64 are spaced from one another a distance which is smaller than the diameter of article 36 defining an elongated access opening 65 therebetween. The outer ends 88 of the interconnecting gripping arms 78 of each extrusion 62*a, b* form a T-shaped end 81 which separates the two columns 64 of each extrusion 62*a, b*. The outer end 90 of each gripping arm 80 is bent slightly outwardly away from the opposite gripping arm 78 to facilitate insertion or removal of an article into or from elongated columns 64, respectively.

As shown in phantom on the righthand portion of FIG. 5 in extrusion 62*b*, the outer ends 88, 90 of gripping arms 78, 80 in each column 64 are deflected or spread apart upon insertion of an article 36 through access opening 65 therebetween as the article 36 is moved into contact with the gripping portions 84, 86. After the article 36 is seated within the gripping portions 84, 86, the outer ends 88, 90 of gripping arms 78, 80 return to their substantially undeflected positions, as shown in solid lines in FIG. 5, so that such outer ends 88, 90 help retain the article 36 between the gripping arms 78, 80 of each column 64.

Figure 8:
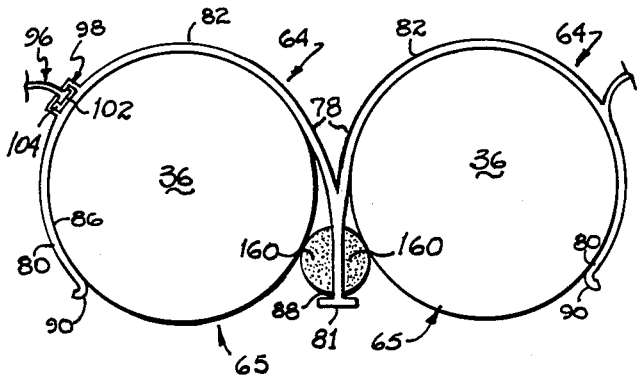
FIG. 8 is an alternative embodiment of the article support rack shown in FIGS. 1-5.

In an alternative embodiment illustrated in FIG. 8, it is recognized that greater variation of the transverse dimension between the gripping portions 84, 86 of each column 64 may be desirable for certain retail establishments. Whereas the gripping portions 84, 86 are capable of securely gripping an item such as article 36 having a given diameter, e.g., a 12 ounce soda can, other items which a seller may want to display such as those having a significantly smaller diameter or items which do not closely conform to the shape of the gripping portions 84, 86 might not be as securely held therebeteween. In order to provide for the support of a wider variety of items within the columns 64, an elongated strip 160 is mounted to each of the adjoining gripping arms 78 of the two columns 64 at or near the outer, T-shaped end 81.

Preferably, the elongated strip 160 is formed of a resilient, compressible material having memory such as the neoprene rubber strips commonly used to form refrigerator seals, or any other material having similar compression and wear properties. The elongated strips 160 are dimensioned to seat at the T-shaped end 81 of the interconnected arms 78 of each extrusion 62 and thus form part of the gripping portions 84, 86 of each column 64. The elongated strips 160 are shown as being generally D-shaped in FIG. 8, but it is contemplated that essentially any other shape could be employed so long as the strips 160 are large enough to contact the smallest article 36 to be inserted within the column 64 and are sufficiently deflectable or compressible to permit insertion of the largest article 36 to be inserted within column 64. In addition, it should be understood that the elongated strips 160 could be formed of essentially any size and/or strips 160 could be placed at various locations along the arms 78, 80 or back portion 82 to accommodate a specific item, e.g., an item of substantially smaller dimension that the transversion dimension between gripping portions 84, 86, so that one size of extrusions 62 could be used for all displays.

Referring now to FIG. 5, adjacent extrusions 62*a* and 62*b* are interconnected with locking elements to form the article support rack 58. A male locking element 96 is formed on the gripping arm 80 of the righthand column 64 of extrusions 62*a*, and a female locking element 98 is formed on the gripping arm 80 of the lefthand column 64 of extrusion 62*b*. The male locking element 96 comprises a flexible arm 100 having a T-shaped end 102. The female locking element 98 comprises a U-shaped channel 104 having a longitudinally extending slot 106. As shown in FIG. 5, the extrusion 62*a* is interconnected with extrusion 62*b* by inserting the T-shaped end 102 of the male locking element 96 of extrusion 62*a* into a U-shaped channel 104 and slot 106 of the female locking element 98 formed on extrusion 62*b*. Other extrusions are then connected to extrusions 62*a, 62b* in the same manner to form the completed article support rack 58. See FIG. 3.

An important feature of the locking structure herein is that a relatively loose fit is provided between the male and female locking elements 96, 98 which permits adjacent extrusions 62 to be positioned at an angle relative to one another. A large number of extrusions 62 can thus be made to conform to an annular shape. As shown in FIGS. 2 and 3, adjacent extrusions 62 are made to conform to the annular periphery of an upper annular ring or spacer 108 mounted by a bracket 109 at the top of cooling column 14, and the lower annular spacer 110 mounted atop the annular article support carriage 60 at the bottom of the housing 20. These spacers 108, 110 function to maintain the extrusions 62 in an annular shape and prevent the extrusions 62 from collapsing radially inwardly when articles 36 are positioned therein or removed therefrom.

It is contemplated that in ordinary use, the article support rack 58 would be loaded with articles 36 by removing cover 34 from the top of housing 20 and inserting articles 36 from the top of article support rack 58, end-to-end, in each of the vertical columns 64. With the cover 34 replaced, and the door frame 44 closed, the article support rack 58 and articles 36 it supports are rotated with the article support carriage 60 within the housing 20 as described above. When a customer desires to remove one or more individual articles 36 from housing 20, he or she opens the door frame 44 when the column 64 containing the articles 36 of choice is positioned at the access opening 38. This opens switch 76 and stops motor 72 as described above. With the article support rack 58 stationary, the customer can remove one or more articles 36 of choice from the column 64 of support rack 58 located at the access opening 38 of housing 20. The door frame 44 is then closed which restarts the motor 72 and resumes rotation of the article support carriage 60 and article support rack 58.

As mentioned above, the article display apparatus 10 of this invention may or may not include a refrigeration system 16 depending upon the types of articles 36 to be displayed therein. A refrigeration system 16 is illustrated in FIG. 1 which is substantially identical to that disclosed in U.S. Pat. No. 4,663,943 or U.S. patent application Ser. No. 07/01,206, filed Feb. 5, 1987, the disclosures of which are incorporated by reference in their entireties herein. Briefly, the cooling column 14 is formed with a plurality of spaced air inlet openings 112 and a plurality of air outlet openings 114 near the top of the housing 20. A cooling coil 116 is mounted within the hollow cooling column 14 between the openings 112, 114 and is connected by an inlet line and an outlet line 118, 120, respectively, to a compressor 122 mounted in the base 12. The compressor 122 is driven by a motor 124 also mounted in the base 12. A blower 126 is carried atop the cooling column 14.

The refrigeration system 16 herein operates as follows. The blower 126 draws air through the inlet openings 112 into the interior of the cooling column 14, over the cooling coil 116 and out the outlet openings 114. The top spacer 108 and flange 109 block the flow of cool air into the space 127 between the cooling column 14 and article support rack 58, so that the cool air is directed into the space 128 between the interior surface of the housing wall 22 and the outside of the article support rack 58. The cooled air flows over the articles 36 carried in the article support rack 58 for efficient cooling thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of this invention without departing from the essential scope thereof.

For example, the extrusions 62 illustrated in FIG. 5 include two columns 64 connected together at one of their gripping arms. It is contemplated, however, that elongated extrusions 130*a* and 130*b* could be formed with only a single elongated column 132 as shown in FIG. 4, or with more than two elongated columns 64 depending upon the requirements of a particular application.

Figure 4:
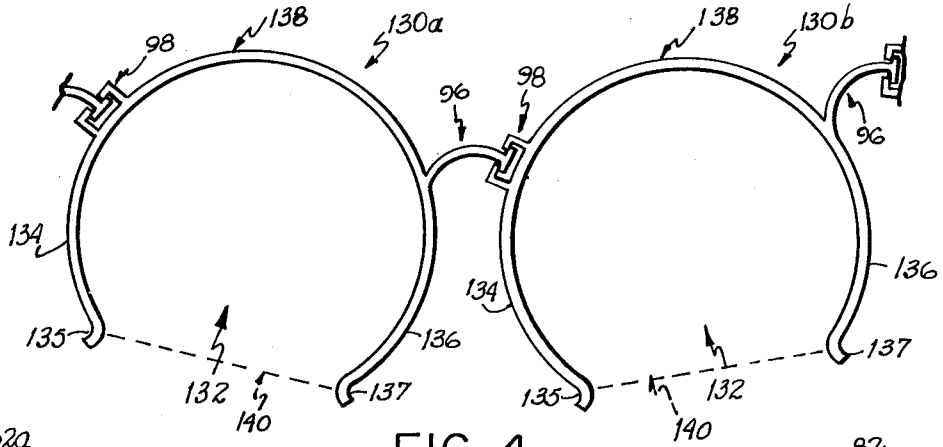
FIG. 4 is a partial, schematic view of one embodiment of the plastic extrusions forming an article support rack herein in which each extrusion is formed with a single vertical column.

In the embodiment of FIG. 4, each extrusion 130*a* and 130*b* has a pair of separate elongated gripping arms 134, 136 with a female locking element 98 being mounted to the gripping arm 134, each extrusion 130*a, b* and a male locking element 96 being mounted to the gripping arm 136 of each extrusion 130*a, b*. Each gripping arm 134, 136 is semicircular in shape and is formed with spaced outer ends 135, 137, respectively, which define an access opening 140 opposite the arcuate, elongated back portion 138 interconnecting the gripping arms 134, 136. The outer ends 135, 137 of this embodiment are bent slightly outwardly away from each other to facilitate the insertion or removal of an article into or from column 132, respectively. Such extrusions 130*a*, 130*b* are otherwise structurally and functionally similar to the extrusions 62*a*, 62*b* of FIG. 5 as described above.

Additionally, it is contemplated that other alternative embodiments of plastic extrusions could be employed to form an article support rack within the teachings of this invention. For example, as shown in FIGS. 6 and 7, elongated extrusions are formed with a number of columns which are interconnected without the use of locking elements 96, 98 illustrated in the embodiments of FIGS. 1–5.

Figure 6:
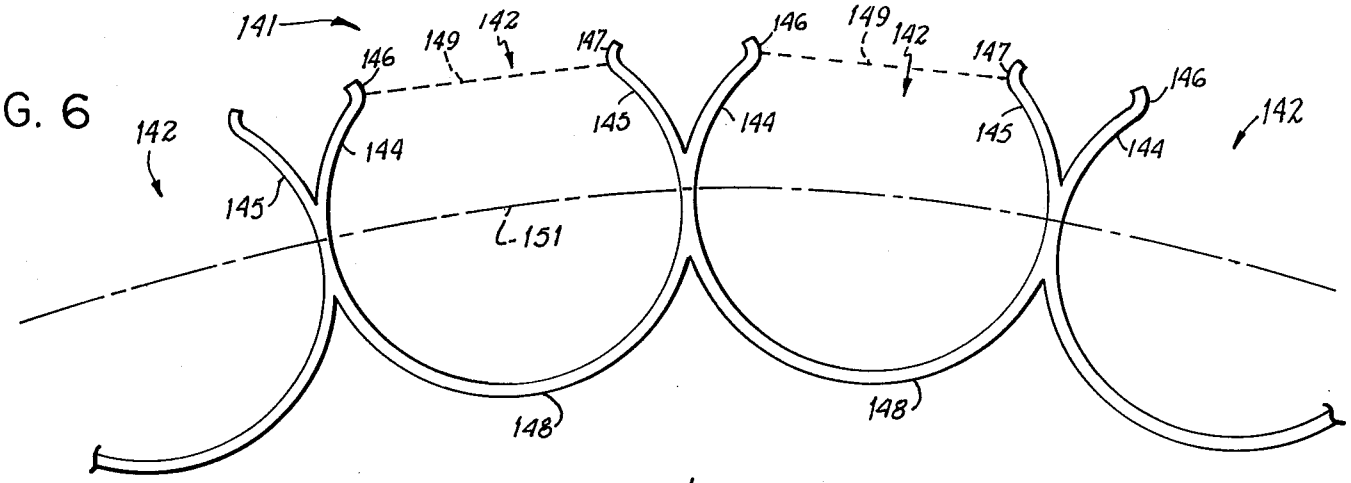
FIG. 6 is an alternative embodiment of plastic extrusions for an article support rack.
Figure 7:
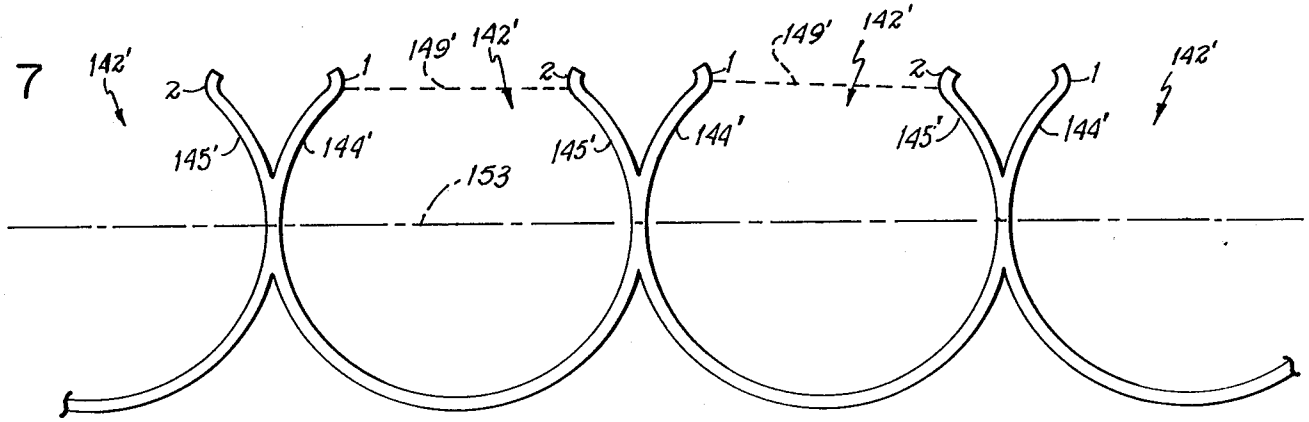
FIG. 7 is a still further embodiment of plastic extrusions for an article support rack.

In the alternative embodiments depicted in FIG. 6, an extrusion 141 is formed with two or more columns 142 each having a pair of elongated gripping arms 144, 145 formed with outer ends 146, 147, respectively, opposite the arcuate, elongated back portion 148 which interconnects the gripping arms 144, 145. The outer ends 146, 147 of gripping arms 144, 145 are bent slightly outwardly away from each other to form an access opening 149 which facilitates the insertion or removal of an article into or from column 142, respectively. The embodiment shown in FIG. 7 has essentially the same structure as that of FIG. 6, and common elements are given the same reference numbers in these Figs. with the addition of a "prime" in FIG. 7.

Preferably, the gripping arms 144, 145 of adjacent columns 142 are connected to one another with adhesive, spot welding, etc., or are integrally formed in the extrusion operation. Depending upon the particular application, the angle at which the gripping arms 144, 145 of adjacent columns 142 are connected to one another may be varied.

For instance, if an annular-shaped support rack is desired, the gripping arm 144 of one column 142 is connected to the gripping arm 145 of an adjacent column 142 along an arc 151 so that adjacent columns 142 are oriented at an angle relative to one another corresponding to the desired annular shape of the article support rack to be formed. See FIG. 6.

On the other hand, if a linear relationship between adjacent columns 142' is desired, the gripping arm 144' of one column 142' is connected to the gripping arm 145' of an adjacent column 142' along a straight line 153. See FIG. 7.

Additionally, although the columns 64, 132 142 and 142' illustrated in FIGS. 4–7, respectively, all have a generally semicircular shape, it is contemplated that they could be formed with article gripping portions having other shapes to conform to the shape of different items to be held with an article support rack 58. For example, the gripping arms could be formed with generally parallel article gripping portions instead of arcuate gripping portions to support square or rectangular-shaped articles.

In another alternative embodiment, housing 20 of article display apparatus 10 may be modified such to exclude the transparent outer wall 22 including door assembly 40 and refrigeration system 16. Such an alternative design would provide the customer with direct access to the articles displayed and supported in each elongated column and would be particularly suited for those articles which do not require refrigeration.

Therefore, it is intended that the invention not be limited to the particular embodiments disclosed as the best mode contemplated for carrying out this invention, but that the invention will include all embodiments falling within the scope of the appended claims.

Having thus described our inventions, we claim:

1. An article holder for removably supporting a plurality of articles end-to-end, comprising:

an elongated backing portion having an axial length;

at least one pair of spaced, flexible first and second gripping arms extending along the axial length of said elongated backing portion, said first gripping arm having an article gripping portion and an outer end opposed to an article gripping portion and an outer end, respectively, of said second gripping arm, the transverse dimension between said opposed article gripping portions being about equal to the transverse dimension of an article to be held therebetween, the transverse dimension of said opposed outer ends being less than said transverse dimension of the article wherein said opposed outer ends define an elongated access opening therebetween so that said opposed outer ends are spread apart from an undeflected position upon insertion or removal of an article through the elongated access opening;

a male locking element connected to one of said backing portion and said first gripping arm, and a female locking element connected to one of said backing portion and said second gripping arm, said male locking element of a first pair of first and second gripping arms being matable with a female locking element of a second pair of first and second gripping arms for releasably connecting said first and second pairs of gripping arms together.

2. The article holder of claim 1 in which said opposed first and second gripping arms are each arcuate in shape.

3. The article holder of claim 1 in which said opposed first and second gripping arms are interconnected opposite said opposed outer ends thereof to form said backing portion.

4. The article holder of claim 1 in which said male locking element comprises a leg connected at one end to one of said backing portions and said first gripping arm, the other end of said leg being formed in a T-shape.

5. The article holder of claim 4 in which said female locking element comprises a U-shaped channel having a pair of spaced legs connected at one end to one of said backing portion and said second gripping arm, the other end of each said legs being formed with a tab, said tabs extending toward one another with a gap therebetween, a longitudinally extending slot being formed between said backing portion or said second gripping arm at one end of said legs and said opposed tabs at the other end of said legs, said T-shaped end of said male locking element of one pair of first and second gripping arms being insertable through said gap between said tabs and into said slot of said U-shaped channel of said female locking element of a second pair of first and second gripping arms to connect said pairs of gripping arms together.

6. The article holder of claim 1 in which said first and second gripping arms are formed of a rigid polyvinylchloride.

7. The article holder of claim 1 in which said holder is extruded from a rigid plastic.

8. The article holder of claim 7 in which said rigid plastic is a rigid polyvinylchloride.

9. The article holder of claim 1 in which said opposed outer ends are bent slightly outwardly away from said elongated access opening therebetween for facilitating said insertion or removal of an article from between said opposed article gripping portions.

10. The article holder of claim 1 in which an elongated, resilient strip is mounted to at least one of said first gripping arm and said second gripping arm for frictionally engaging and gripping articles between said first and second gripping arms to prevent the articles from falling out of said elongated access opening between said first and second gripping arms.

11. The article holder of claim 10 in which said elongated, resilient strip is formed of a compressible material having memory.

12. The article holder of claim 10 in which said elongated, resilient strip is D-shaped in cross section.

13. An article holder for removably supporting a number of articles end-to-end, comprising:

at least one plastic extrusion including a first article support column and a second article support column;

said first article support column of said plastic extrusion comprising:

(i) first and second gripping arms, said first gripping arm having an article gripping portion and an outer end opposed to an article gripping portion and and outer end, respectively, of said second gripping arm, said outer ends of said first and second gripping arms defining an access opening therebetween, said first and second gripping arms being interconnected opposite said outer ends thereof, and (ii) a female locking element mounted to said second gripping arm;

said second article support column of said plastic extrusion comprising:

(i) first and second gripping arms, said first gripping arm having an article gripping portion and an outer end opposed to an article gripping portion and an outer end, respectively, of said second gripping arm, said opposed outer ends of said first and second gripping arms defining an access opening therebetween, said first and second gripping arms being interconnected opposite said outer ends thereof, (ii) said first gripping arm of said second article support column being connected to said first gripping arm of said first article support column, and (iii) a male locking element mounted to said second gripping arm, said male locking element on said second article support column of a first plastic extrusion being matable with said female locking element on said first article support column of a second plastic extrusion to connect said first and second plastic extrusions together.

14. The article holder of claim 13 in which said opposed first and second gripping arms of said first and second article support columns are each arcuate in shape.

15. The article holder of claim 13 in which said male locking element comprises a leg connected at one end to said second gripping arm of said second article support column, the other end of said leg being formed with a T-shaped end.

16. The article holder of claim 15 in which said female locking element comprises a U-shaped channel having a pair of spaced legs connected at one end to said second gripping arm of said first article support column, the other end of each said legs being formed with a tab, said tabs extending toward one another with a gap therebetween, a longitudinally extending slot being formed between said opposed tabs of said legs and said second gripping arm, said T-shaped end of said male locking element being insertable through said gap between said tabs and into said slot of said U-shaped channel of said female locking element to releasably connect said locking elements together.

17. The article holder of claim 13 in which said plastic extrusions are formed of a rigid polyvinylchloride.

18. The article holder of claim 13 in which said outer end of said second gripping arm of said second article support column and said outer end of said second gripping arm of said first article support column are bent slightly outwardly away from said access openings for facilitating insertion or removal of an article through said access openings.

19. The article holder of claim 13 in which a first resilient, elongated strip is mounted to said first gripping arm of said first article support column opposite said second gripping arm thereof, and a second resilient, elongated strip is mounted to said first gripping arm of said second article support column opposite said second gripping arm thereof to prevent the articles from falling out of said elongated access opening between said first and second gripping arms of each said first and second article support columns.

20. The article holder of claim 19 in which said first and second resilient, elongated strips are formed of a compressible material having memory, said first and second resilient, elongated strips being generally D-shaped in cross section.

21. An elongated, deflectable rack for displaying and removably supporting a plurality of articles stacked end-to-end therein, comprising:

an elongated, continuous backing portion;

at least one pair of spaced, flexible first and second gripping arms connected along the axial length of said elongated, continuous backing portion, said first and second gripping arms having opposed article gripping portions and opposed outer ends defining an elongated access opening therebetween;

an elongated resilient strip mounted to at least one of said first gripping arm and said second gripping arm said continuous backing for frictionally engaging and gripping articles stacked end-to-end between said first and second gripping arms, said resilient strip forcing the articles against one of said first and second gripping arms to prevent the articles from falling out of said elongated access opening between said first and second gripping arms.

22. The elongated deflectable rack of claim 21 in which said elongated, resilient strip is formed of a compressible material having memory.

23. The elongated deflectable rack of claim 21 in which said elongated resilient strip is D-shaped in cross section.

24. An article display apparatus for displaying and removably supporting a plurality of articles stacked end-to-end therein, comprising:

a base support;

a housing having an outer wall and a hollow interior, said housing being mounted to said base support;

door means mounted over an access opening formed in said outer wall of said housing, said door means being movable between an open position and a closed position;

an annular article support carriage mounted to said base support at the bottom of said housing;

an annular-shaped article support rack mounted atop said article support carriage, said article support rack including a plurality of elongated, deflectable columns interconnected at an angle relative to one another, each of said columns comprising:

(i) an elongated backing portion having an axial length;

(ii) a pair of spaced, flexible first and second gripping arms extending along the axial length of said elongated backing portion, said first gripping arm having an article gripping portion and an outer end opposed to an article gripping portion and an outer end, respectively, of said second gripping arm, said outer ends of said first and second gripping arms defining an elongated access opening therebetween;

(iii) said first gripping arm of a first one of said columns being directly connected to a gripping arm of a second one of said columns, said second gripping arm of said first column being directly connected to a gripping arm of a third one of said columns;

(iv) the transverse dimension between said opposed article gripping portions of each said columns being less than the transverse dimension of an article, said article gripping portions frictionally engaging and gripping a plurality of articles stacked end-to-end therein, said elongated access opening between said opposed outer ends of each said columns being less than said transverse dimension of said article gripping portions so that upon insertion or removal of one article into or from one said article gripping portions said opposed outer ends of said gripping arms are spread apart from an undeflected position to a deflected position in a localized area of said elongated access opening therebetween, said opposed outer ends of said gripping arms permitting insertion or removal of the one article from said column while continuing to support the remaining articles end-to-end therein, said opposed outer ends returning to their substantially undeflected positions subsequent to such insertion or removal of an article therebetween.

25. The article holder of claim 24 in which said opposed first and second gripping arms of each said columns are each arcuate in shape.

26. The article holder of claim 24 in which each said rack is extruded from a rigid plastic.

27. The article holder of claim 26 in which said rigid plastic is a rigid polyvinylchloride.

28. The article holder of claim 24 in which said opposed outer ends are bent slightly outwardly away from said elongated access opening therebetween for facilitating said insertion or removal of an article.

29. An article rack of claim 24 in which an elongated, resilient strip is mounted to at least one of said first gripping arm and said second gripping arm for frictionally engaging and gripping articles between said first and second gripping arms to prevent the articles from falling out of said elongated access opening between said first and second gripping arms.

30. An article rack of claim 29 in which said elongated, resilient strip is formed of a compressible material having memory.

31. An article rack of claim 29 in which said elongated, resilient stip is D-shaped in cross section.

32. The article display apparatus of claim 24 in which said article support carriage is rotatably mounted on a bearing carried by sadi base support, said article support carriage being rotated on said bearing relative to said base support by a friction wheel resting atop said article support carriage, said friction wheel being drivingly connected to a motor.

33. The article display apparatus of claim 32 in which said motor is activated by a switch operatively connected to said door means, said door means in said closed position being effective to close said switch and activate said motor to rotate said article support carriage, said door means in said open position being effective to open said switch to deactivate said motor and stop the rotation of said article support carriage.

34. The article display apparatus of claim 24 further including means for cooling said hollow interior of said housing.

35. An article display apparatus, comprising:

a base support;

an housing having an outer wall and a hollow interior, said housing being mounted to said base support;

door means mounted over an access opening formed in said outer wall of said housing, said door means being movable between an open position and a closed position;

an article support carriage mounted to said base support at the bottom of said housing; and an article support rack mounted to said article support carriage for supporting articles stacked end-to-end in spaced, vertical columns atop said article support carriage, said article support rack comprising (i) at least one pair of spaced, flexible first and second gripping arms, said first gripping arm having an article gripping portion and an outer end opposed to an article gripping portion and an outer end, respectively, of said second gripping arm, the transverse dimension between said opposed article gripping portions being about equal to the transverse dimension of an article to be held therebetween, the transverse dimension of said opposed outer ends being less than said transverse dimension of the article so that said outer ends are spread apart from an undeflected position upon insertion or removal of an article therebetween, and (ii) a male locking element connected to one of said backing portion and said first gripping arm, and a female locking element connected to one of said backing portion and said second gripping arm, said male locking element of a first pair of first and second gripping arms being matable with a female locking element of a second pair of first and second gripping arms for releasably connecting said first and second pairs together.

36. The article display apparatus of claim 35 in which said outer wall of said housing is cylindrical in shape, said access opening extending substantially along the entire axial length of said outer wall to permit access to said hollow interior of said housing.

37. The article display apparatus of claim 35 in which said article support carriage is rotatably mounted on a bearing carried by said base support, said article support carriage being rotated on said bearing relative to said base support by a friction wheel resting atop said article support carriage, said friction wheel being drivingly connected to a motor.

38. The article display apparatus of claim 37 in which said motor is activated by a switch operatively connected to said door means, said door means in said closed position being effective to close said switch and activate said motor to rotate said article support carriage, said door means in said open position being effective to open said switch to deactivate said motor and stop the rotation of said article support carriage.

39. The article display apparatus of claim 35 in which said opposed first and second gripping arms are each arcuate in shape.

40. The article display apparatus of claim 35 in which said male locking element comprises a leg connected at one end to one of said backing portion and said first gripping arm, the other end of said leg being formed in a T-shape.

41. The article display apparatus of claim 40 in which said female locking element comprises a U-shaped channel having a pair of spaced legs connected at one end to one of said backing portion and said second gripping arm, the other end of each said legs being formed with a tab, said tabs extending toward one another with a gap therebetween, a longitudinally extending slot being formed between said backing portion or said second gripping arm at one end of said legs and said opposed tabs at the other end of said legs, said T-shaped end of said male locking element of one pair of gripping arms being insertable through said gap between said tabs and into said slot in said U-shaped channel of said female locking element of a second pair of gripping arms to connect said pairs of gripping arms together.

42. The article display apparatus of claim 35 in which an elongated, resilient strip is mounted to at least one of said first and second gripping arms for frictionally engaging and gripping articles therebetween.

43. The article display apparatus of claim 42 in which said elongated, resilient strip is formed of a compressible material having memory.

44. The article display apparatus of claim 42 in which said elongated, resilient strip is D-shaped in cross section.

45. An article display apparatus, comprising:

a base support;

a housing having an outer wall and a hollow interior, said housing being mounted to said base support;

door means mounted over an access opening in said housing, said door means being movable between an open position and a closed position;

an article support rack mounted to said article support carriage for supporting articles stacked end-to-end in spaced, vertical columns atop said article support carriage, said article support rack inluding a plurality of plastic extrusions each including a first article support column and a second article support column;

said first article support column of each plastic extrusion comprising:

(i) first and second gripping arms, said first gripping arm having an article gripping portion and an outer end opposed to an article gripping portion and an outer end, respectively, of said second gripping arm, said first and second gripping arms being interconnected opposite said outer ends thereof, and (ii) a female locking element mounted to said second gripping arm;

said second article support column of each plastic extrusion comprising:

(i) first and second gripping arms, said first gripping arm having an article gripping portion and an outer end opposed to an article gripping portion and an outer end, respectively, of said second gripping arm, said first and second gripping arms being interconnected opposite said outer ends thereof, (ii) said first gripping arm of said second article support column being connected to said first gripping arm of said first article support column, and (iii) a male locking element mounted to said second gripping arm, said male locking element of a first plastic extrusion being matable with said female locking element of a second plastic extrusion to connect said first and second plastic extrusions together.

46. An article display apparatus as in claim 45 further including means for cooling said hollow interior.

47. An article display apparatus of claim 45 in which a first resilient, elongated strip is mounted to said first gripping arm of said first article support column opposite said second gripping arm thereof, and a second resilient, elongated strip is mounted to said first gripping arm of said second article support column opposite said second gripping arm thereof.

48. The article display apparatus of claim 45 in which said first and second resilient, elongated strips are formed of a compressible material having memory, said first and second resilient, elongated strips being general D-shaped in cross section.

49. The article display apparatus of claim 24 in which said outer wall of said housing is transparent.

* * * * *

UNITED STATES PATENT AND TRADEMARK OFFICE

CERTIFICATE OF CORRECTION

PATENT NO. : 4,848,856

DATED : July 18, 1989

INVENTOR(S) : James A. Dyment et al

It is certified that error appears in the above-identified patent and that said Letters Patent is hereby corrected as shown below:

Column 1, line 29, "implulse" should be --impulse--.

Column 6, line 30, "movfed" should be --moved--.

Column 7, line 17, "9f" should be --of--.

Column 12, line 16, "and and" should be --and an--.

Column 13, line 38, delete "said continuous backing".

Column 14, line 37, after "articles" insert --stacked--.

Column 14, line 66, "sadi" should be --said--.

Delete Claim 46.

Signed and Sealed this

Twelfth Day of June, 1990

*Attest:*

HARRY F. MANBECK, JR.

*Attesting Officer*

*Commissioner of Patents and Trademarks*